United States Patent [19]

von Schuckmann

[11] Patent Number: 4,746,226

[45] Date of Patent: May 24, 1988

[54] PACKAGING CONTAINER

[75] Inventor: Alfred von Schuckmann, Kevelaer, Fed. Rep. of Germany

[73] Assignee: Bramlage Gesellschaft mit beschraenkter Haftung, Oldenburg, Fed. Rep. of Germany

[21] Appl. No.: 923,129

[22] Filed: Oct. 24, 1986

[30] Foreign Application Priority Data

Oct. 24, 1985 [DE] Fed. Rep. of Germany ..... 3537766

[51] Int. Cl.[4] ..... B65D 33/16

[52] U.S. Cl. ..... 383/71; 383/74; 206/601; 206/628; 229/69

[58] Field of Search ..... 383/71, 74, 37; 206/820, 802, 602, 601; 229/69; 24/30.5 R, 335, 703

[56] References Cited

U.S. PATENT DOCUMENTS

| | | | |
|---|---|---|---|
| 3,469,760 | 9/1969 | Rausing et al. | 206/601 |
| 3,497,131 | 2/1970 | Tracy | 206/628 |
| 3,780,488 | 12/1973 | Herrell | 383/71 |
| 4,166,571 | 9/1979 | Niedecker | 383/71 |
| 4,197,983 | 4/1980 | Randys | 383/71 |
| 4,223,043 | 9/1980 | Johnson | 229/69 |
| 4,275,485 | 6/1981 | Hutchinson | 383/71 |

FOREIGN PATENT DOCUMENTS

| | | | |
|---|---|---|---|
| 596311 | 7/1959 | Italy | 383/71 |

*Primary Examiner*—Willis Little

*Attorney, Agent, or Firm*—Collard, Roe & Galgano

[57] ABSTRACT

There is provided a storage container for paste-like substances, for example mayonnaise, in the shape of a bag with collapsible walls mounted within a pump-operated dispensing unit. The wall of the bag includes a segmentally crimped tube tightly sealed at one extremity with a clamp which is part of a double clamping device with an intermediate transverse separation band. The clamp segment which faces the bag cavity may be detachable from the crimped section.

7 Claims, 7 Drawing Sheets

PACKAGING CONTAINER

The present invention relates to a storage container for paste-like substances, such as mayonnaise, in the shape of a bag having collapsible walls, mounted within a pump-operated dispensing unit.

A bag-shaped storage container for a dispenser unit is disclosed in U.S. Pat. No. 2,608,320, to Harrison, granted Aug. 26, 1952. The bag in this patent is connected to the rim of the open extremity of a cartridge, so that the storage container consists partly of a rigid and partly of a flexible segment. As the operation of the dispenser presses out the contents, the bag ultimately tips over completely into the cartridge. The dispensing orifice is located at the bottom of the cartridge. A storage container according to this patent is costly to manufacture and inconvenient to fill.

The object of the present invention is to complement the above-described multi-directional dispenser with a storage container that is simpler to manufacture and fill, affording an efficient, loss-proof combination, and in addition a tight seal.

The above object is accomplished in accordance with the present invention by a storage container that is simple to manufacture and efficient in use consisting of tubular sections with segmented constrictions which form a chain of tight individual storage containers, thereby prolonging storage life. Depending on the configuration of the dispenser, it may be designed to take up just one storage container out of such chain of containers. The structural means necessary to form the crimped segments are simple and efficient, utilizing a clamp which tightly grips the bag wall where it is crimped, the same being part of a double clamping arrangement with an in-between transverse separation band, whereby at least the clamp segment facing the bag cavity may be detached from the crimped section. Once separated, the two facing ends of the two bags are still sealed. In this way, the other identically constructed extremity may be opened, once in place, thus making it possible to dispense portions by way of the pump-activated device in the dispenser unit. The unopened part at the other end of such a bag affords a safe and durable closure at the bottom of the bag. However, it is also possible and advantageous to form the transverse separation band by means of a transverse slot through the wall of the bag and an adjoining transverse separation band in the double clamp. The open transverse slot facilitates the proper application of the separation tool and contributes in addition to the proper guidance of the cutting blade. The separation band can thereafter be readily broken off. For greater ease of operation, it is furthermore advantageous to have the detachable portion of the clamp operable. This protects the wall of the bag in that the closure cannot be inadvertently removed. A particularly simple solution in this respect is that the detachable portion of the clamp may be pulled off. Even a less sturdy clamp grip used for this purpose will prove surprisingly secure in handling, when inserted in the bottom portion of the dispenser housing, above all when the bag is inserted first, and is only then separated from the remaining string of bags. It is advantageous for one part of the clamp to be longer than the other. This ensures a larger, that is to say axially longer, crimped area in the corresponding portion of the bag wall. Hence, as the clamp part is opened, the contents do not ooze out; instead, there is a sufficient surmounting clearance between the rim of the bag and the expanding level of the contents. This surmounting space is sufficient even in the case in which the pump-activated dispensing device features an upright tube immersed in the contents, reaching down to virtually the bottom of the bag, raising somewhat the level of the contents by reason of the displacement. Lastly, in relation to the operable portion of the clamp, it is advantageous for the clamp legs to form a slip closure. This may be accomplished by suitably shaped clipping tabs and clipping notches. It is further advantageous if the portion of the clamp facing the bag cavity is shaped on such facing edge as a rounded funnel. This ensures a smoother support profile, better fitted to the waistline shape in the area of transition between the taut bag cavity and the crimping area so that sharp edges, for example, cannot damage the walls of the bag. Lastly, the invention further envisages for the crimped tube designed to break down into dispenser bags that the crimped band between any two bags be formed of a double clamp and an adjoining individual clamp. Such a provision ensures completely equally tight seals at both ends of the bag, whereby the double clamp with its single clamp segment again ensures the formation of extra wall length at the bag end designed to be opened. This permits sturdier handling and separation, whereby it remains possible to cut off the other portion of the clamp preferably while the dispenser is in its shut-off position.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
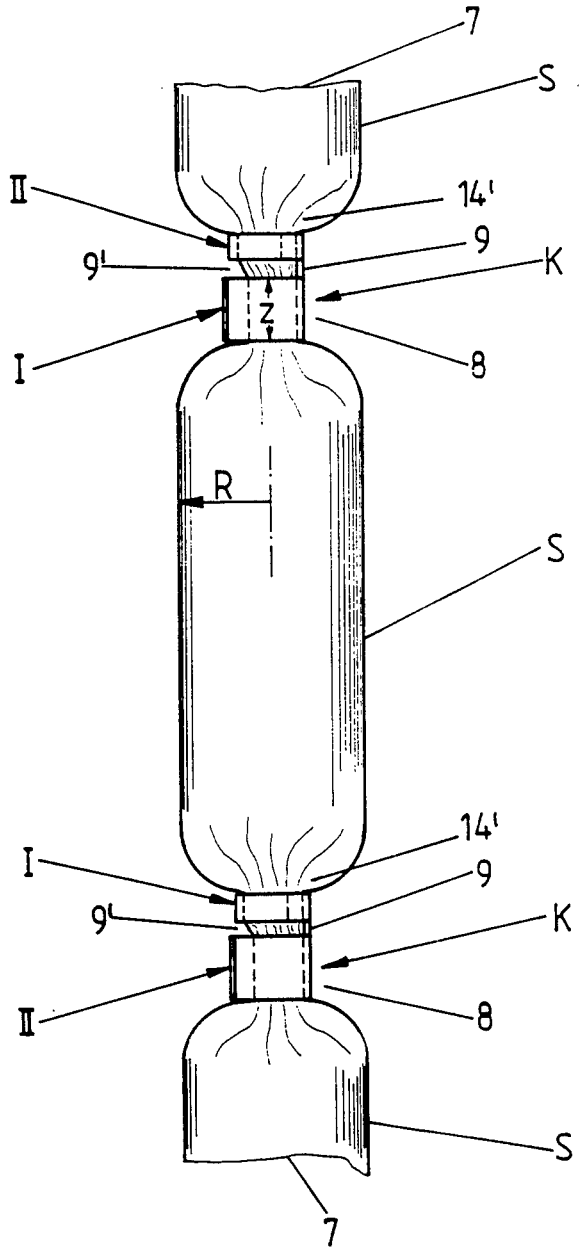
FIG. 1 is a side view of one embodiment of the present invention which illustrates a bag consisting of a segmentally crimped tube in a sequence of bags.
Figure 2:
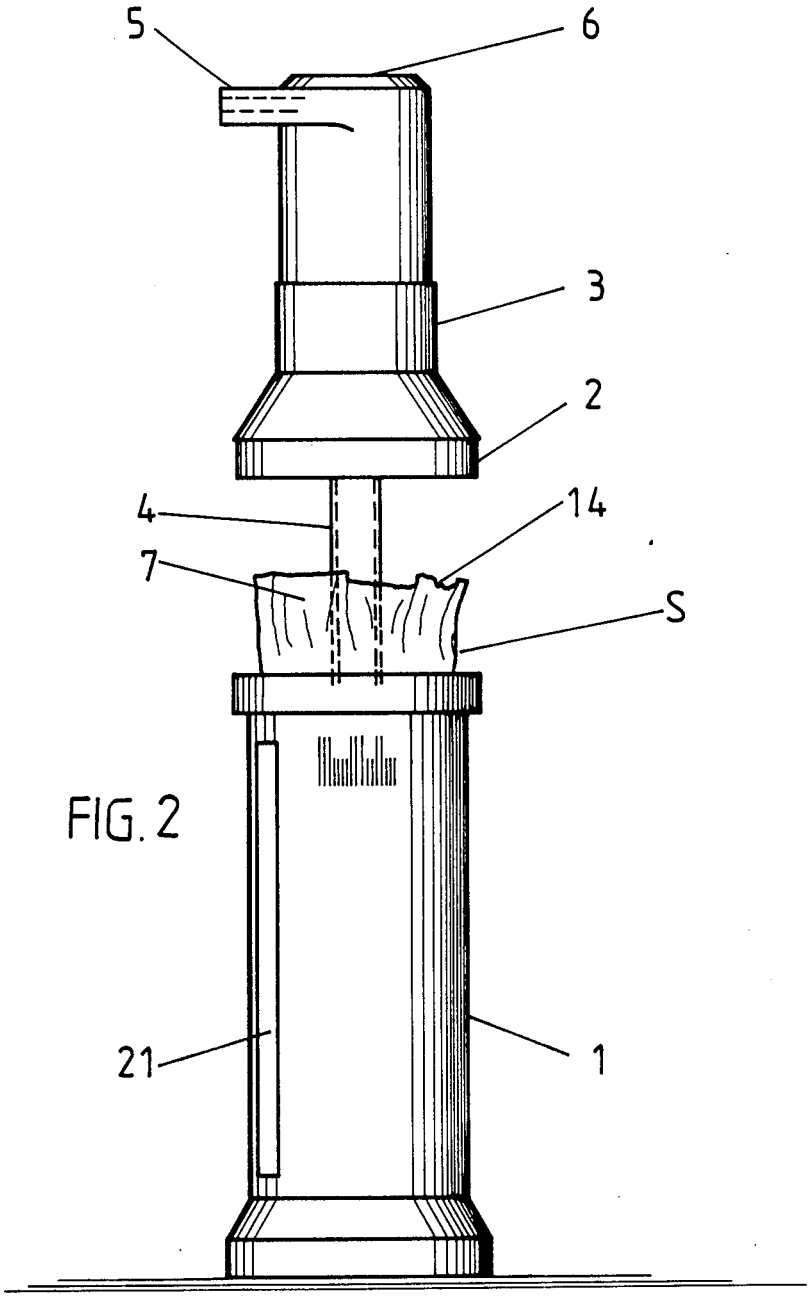
FIG. 2 is a side view showing a detached bag segment inserted in the housing of a dispenser, with the pump actuated dispensing device not yet fully in place.
Figure 3:
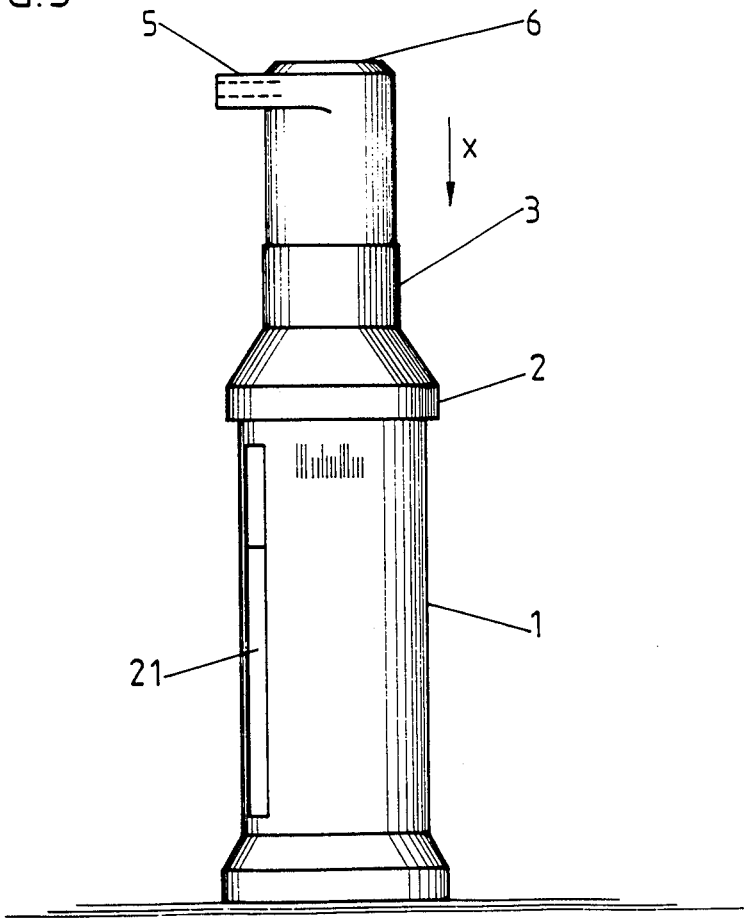
FIG. 3 is a side view showing the dispenser of FIG. 2 fully assembled.
Figure 4:
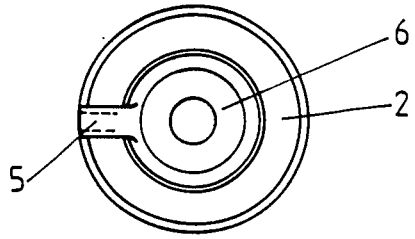
FIG. 4 is a top plan view of the dispenser shown in FIG. 3.
Figure 5:
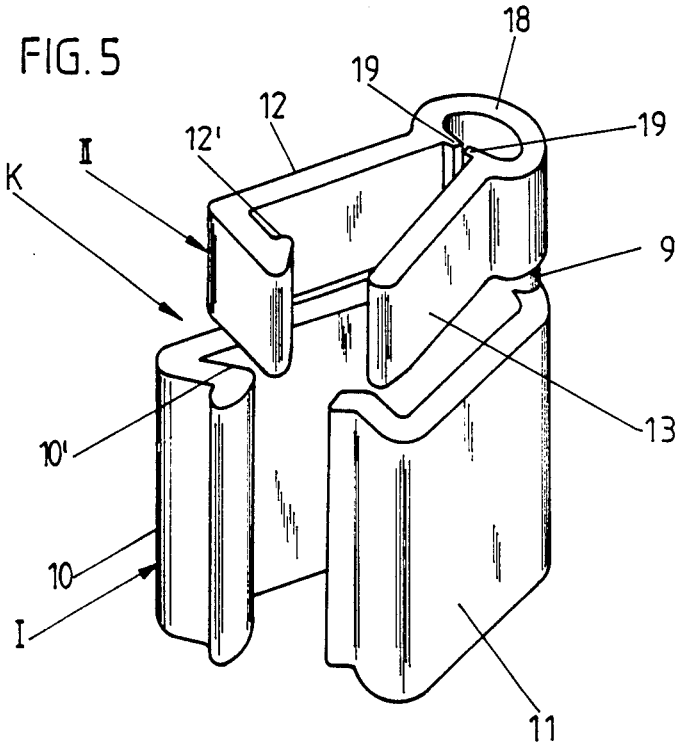
FIG. 5 is an enlarged perspective view of the clamp in its open position.
Figure 6:
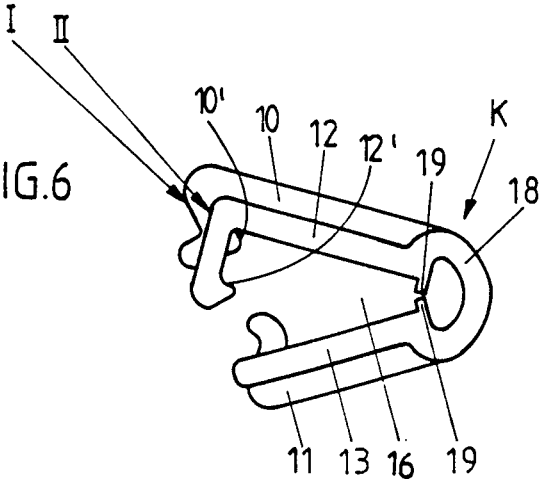
FIG. 6 is a top plan view of the clamp of FIG. 5.
Figure 7:
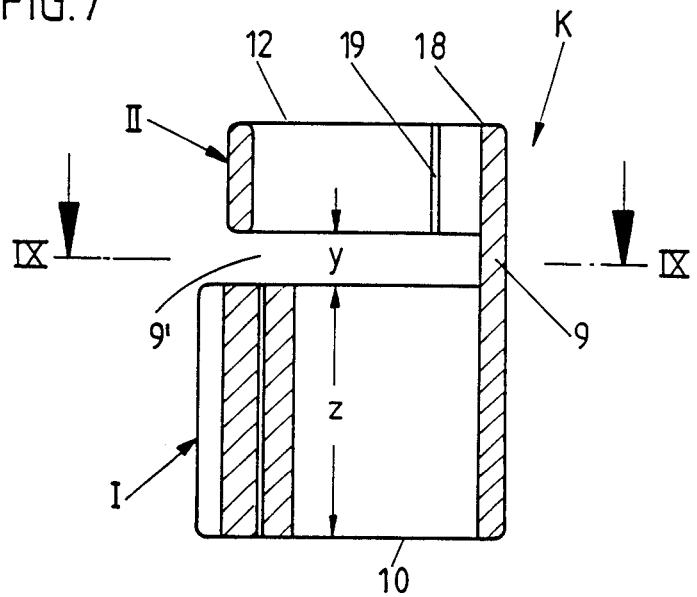
FIG. 7 is a vertical cross-sectional view of the clamp in its closed state.

Now turning to the drawings, there is shown in FIGS. 2 and 3 dispenser which consists of a lower housing 1 accommodating the bag-shaped storage container S, with an upper housing portion 2 enclosing the same. Upper portion 2 of the housing extends upward into a pump operated dispensing device 3 having a riser tube 4 projecting in the direction of the lower portion of the housing. With the dispenser properly assembled, riser tube 4 reaches virtually all the way to bottom 14' of bag S (FIG. 1). Tube 14 is positioned in the center and is in fluid communication with an outlet orifice 5 provided in the pump head, which features a beak-shaped lateral projection. The pump head doubles as operating handle 6. To dispense the paste-like substance, the pump head is moved downwardly in the direction of arrow X against the resistance of a return spring (not shown).

Bag S, as clearly seen in FIG. 1, is formed of a tube 7 filled with the paste-like substance. Segments of the tube are crimped off or constricted. The constricted or crimped areas are generally designated by reference numeral 8. Clamp K serves as the means of constriction.

Figure 14:
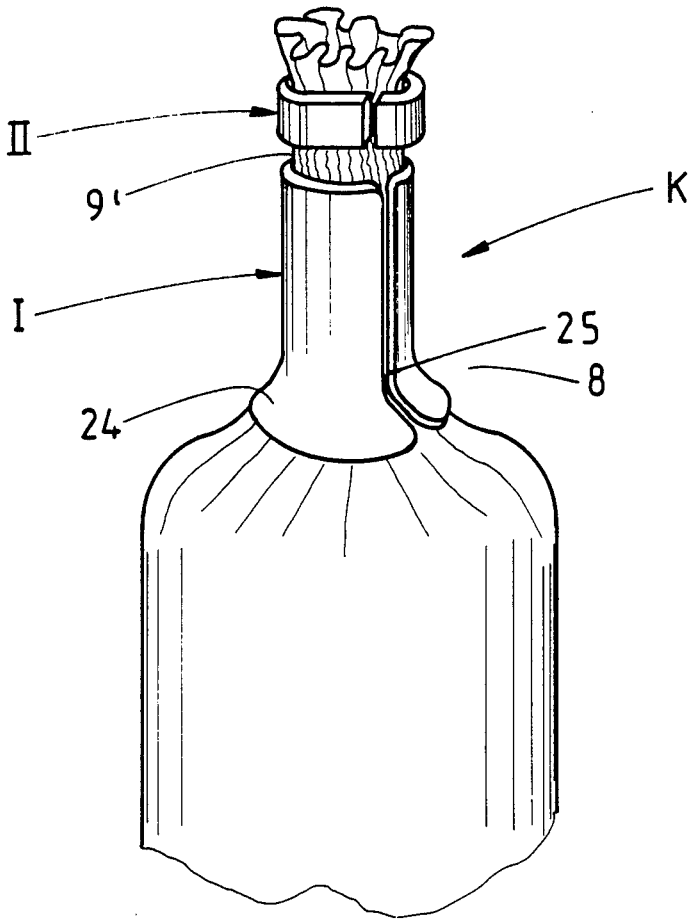
FIG. 14 is a perspective view of the upper end of the bag, with a further structural refinement of the double clamp.

Clamp K tightly crimps the wall of the bag in the pinched areas 8. For this purpose, the material of the bag is suitably flexible. Clamp K, which crimps the bag over a relatively long segment, is part of a double clamp having an intermediate separation band which may consist of a continuous separation band as illustrated in FIG. 14 or of a configuration designed so that this segment, designated I, is connected by means of a transverse separation band 9 with surmounting segment II of the twin clamp. As can be appreciated from the drawing, this involves a flat clamp with a U-shaped base. Clamp legs 10 and 11 of clamp segment I may be operated independently against clamp legs 12 and 13 of the clamp segment II. Such independent operation is afforded by transverse slot 9' adjoining the transverse separation band 9. Its width y measured in the direction of the tube elongation matches at least the width of a household knife blade, so that the crimped bag wall is completely exposed for purposes of a separation cut. Such a cut may also include the transverse separation band 9.

The height z of segment I of clamp K lying in the direction of separation is about double or triple the height of adjoining segment II of clamp K facing in the same direction. In turn, this height z matches substantially the radius R of tube 7 which is circular in cross section.

By appropriate 'neutralization' of a given lengthwise segment within crimped region 8, there is created after removal of segment II of clamp K in the upper segment of bag S a sufficiently large substance-free area, thereby avoiding losses. This is so because the filling process and the weight of the contents builds up an inner pressure which would cause the contents to spurt out at the slightest piercing of the foil. Any loss is avoided in this way. In fact, the level of the contents recedes so much in relation to edge 14 of the bag that there is no spilling over even if riser tube 4 of dispensing device 3 is immersed, thereby causing a modest rise in the level of the contents. At the same time, this also avoids soiling the dispenser housing since only the riser tube comes into contact with the product. Inasmuch as the pump is ordinarily made of non-oxidizing material, mostly plastic, no problems arise in this respect either. Beyond that, such a pump may be cleaned by pumping through suitable rinsing water.

Figure 8:
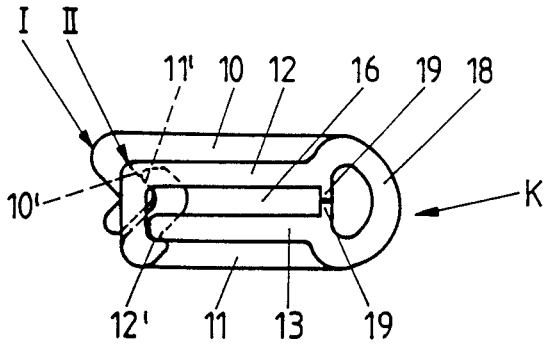
FIG. 8 is a top plan view of the clamp shown in FIG. 7.
Figure 9:
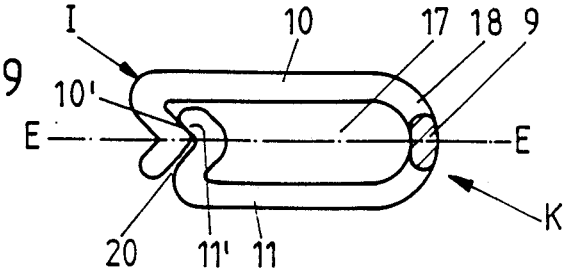
FIG. 9 is a cross-sectional view of the clamp of FIG. 7 taken along line IX—IX of FIG. 7.
Figure 10:
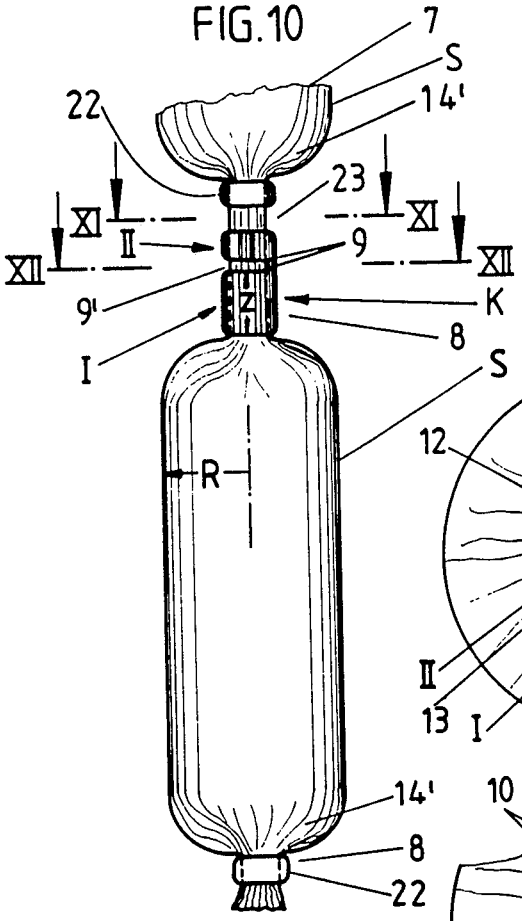
FIG. 10 is a side view of another embodiment of the present invention similar to that shown in FIG. 1, utilizing a single clamp adjoining the double clamp.

The smaller segment II of clamp K is not removable except possibly by the application of considerable force, so that improper operation is virtually precluded. Beyond that, the configuration of clamp segment portion II is appreciably smaller, so that the same will be recognized as the element tightly sealing bottom 14'. Conversely, larger segment I of clamp K, which constitutes the detachable closure of the bag, as can be observed from its orientation and sequence visible in FIG. 1, can be readily gripped and detached. The removal requires no more than a simple peeling off in the axial direction. Here, the correspondingly lower clamping force may be acquiesced in, considering that adjoining segment II of clamp K forming the bottom closure possesses a higher clamping efficiency, as a consequence of the reduced cross-section of clamp jaw 16. Clamp jaw 17 of clamp segment I has a cross section about three times greater than that of segment II (compare FIG. 8 and FIG. 9). Beyond that, the hooked end of clamp leg 12 features an upright flank 12' positioned opposite the direction of expansion, while the corresponding flank 10' of clamp leg 10 on part I rises obliquely, the counterflank 11' of clamp leg 11 being shaped to match. To this end, the free extremities of the two clamp legs 10 and 11 forming the clip closure have an S-shaped profile. The clamp legs 10, 11 and 12, 13 which are otherwise parallel to each other, meet each other in a roughly semicircular loop 18 at the level of transverse separation band 9. Such transverse separation band 9 extends over just a portion of this loop, lying centrally in the lengthwise plane E—E of clamp K. The expansion force of the clamps is the result of the restoring force of the material. The leg extremities facing loop 18 are slightly constricted so as to reduce cross section 16 as compared to loop 18, form on their interior when the clamps are closed the counteropposed connecting strips 19 running parallel to the transverse separation band 9. Such strips extend over the entire height of clamp segment II. Strips 19 are available to produce greater clamping pressure between the clamp legs 12, 13 affording in any event extra strength to this portion of clamp segment II.

As the expansion of clamp segment I progresses, overcoming the arresting force of the clip, it is possible to insert into gap 20 between the clip-actuated ends of the corresponding clamp legs a tool, for example a knife blade. A slight twist suffices to spread apart the connecting segments.

On the side of housing 1, it is possible to provide, for example by a printing process, a peephole 21 so that the contents of the bag can at all times be visualized, if the bagging material is suitably transparent or translucent.

Figure 11:
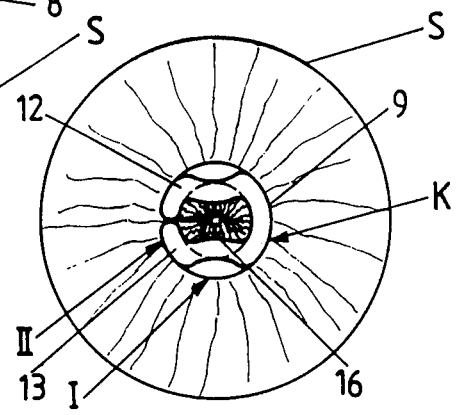
FIG. 11 is a cross-sectional view of the embodiment of FIG. 10 taken along line XI—XI of FIG. 10.
Figure 12:
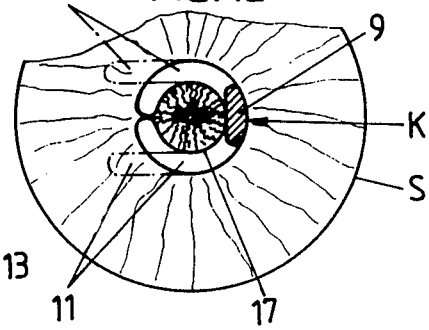
FIG. 12 is a cross-sectional view taken along line XII—XII of FIG. 10.
Figure 13:
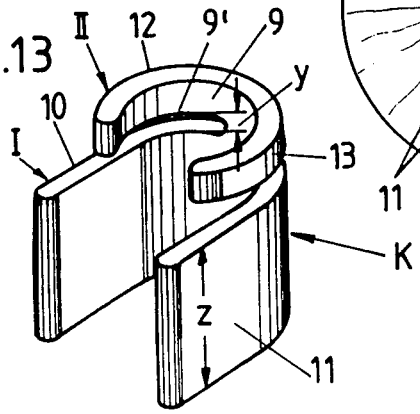
FIG. 13 is an enlarged perspective view of the clamp in the open position.

The configuration consistent with the second embodiment (FIGS. 10 to 13) matches in many particulars the embodiment already described in detail, so that the same reference numerals apply, even without a repetition of the text. According to this second embodiment, the tube crimped for the purpose of breaking down into individual bags S is constructed in such a way that each crimped section 8 between any two bags S is formed by a double clamp and an axially adjoining single clamp 22. Thus, the sealing of bottom 14' of bag S is no longer the function of clamp segment II of clamp K. In this case, clamp segment II of clamp K seals the bag extremity forming edge 14, in other words, the extremity of bag S capable of being opened in a functional manner. The separation of the bags the one from the other occurs in section 23 between the mentioned individual clamp 22 and clamp K of the next following bag S. In this section 23, the wall of the bag is also draped in much the same way as in the area of the transverse slot 9′ of the clamp K. The legs 12 and 13 of clamp segment II of clamp K are corrugated, as clearly seen in FIG. 11, so that the clamp is severely crimped. Adjoining clamp segment I facing the bag cavity undergoes circular deformation of its legs 10 and 11 thereby virtually turning into a tubular shape as seen in FIG. 12, which holds creased in its grip the wall of the bag, though less constricted than by segment II, so that once segment II is removed in the manner already described, this tubular shape can be readily drawn off the creased neck of the bag. The ensuing spare wall length prevents spillage of the paste-like contents.

In the event that the user prefers to separate the bag with the aid of transverse slot 9′, clamp segment II remains attached to the bag extremity facing the storage tube, once band 9 is separated. The two clips or seals now afford a double tight seal.

The free-standing section 23 matches the height of clamp segment II or of individual clamp 22. Before engagement, the individual clamp and the double clamp have a U-shaped profile, as partly illustrated in dotted lines in FIG. 12.

According to the embodiment illustrated in FIG. 14, clamp K is so constructed that clamp segment I designed as a spacer tube is separate from clamp segment II forming the seal. The two clamp segments are spaced apart so that a separation strip designated by the numeral 9 is present throughout. While clamp segment II may be made of metal, for example, clamp segment I is preferably made of plastic material. A further refinement of clamp segment I resides in the edge thereof facing the bag cavity has a rounded funnel shape. The terminal portion with its matching radial convex shape terminates with a collet 24. The supporting surface is correspondingly enlarged as it conforms in shape to the transition region between the inflowing bag top and the pleated portion of the bag wall.

The appropriate funnel shape extending over the entire length of the tube-shaped spacer piece on the lengthwise slot 25 facing the viewer makes it possible to push the spacer back onto the pleated portion of the bag, in the event that the same is opened in error.

While a few embodiments of the present invention have been shown and described, it will be obvious that many changes and modifications may be made thereunto without departing from the spirit and scope of the invention.

What is claimed is:

1. A storage container for paste-like substances such as mayonaisse, formed in the shape of a bag having collapsible walls, for use within a pump-operated dispenser device, said storage bag comprising a wall formed of a segmentally crimped tube, a clamp tightly sealing one end of said bag, said clamp being part of a double clamping device having an intermediate transverse separation band therebetween, so that at least one segment of said clamping device facing the bag cavity may be detached from the crimp, said removable clamp segment having a greater length than the other segment of said double clamp so that a large substance free area results upon removal of the clamp segment so that loss of any paste-like substance is avoided.

2. The storage container according to claim 1, wherein said transverse separation bend comprises a transverse slot traversed by the wall of the bag and an adjoining transverse seprartion band of the double clamp.

3. The storage container according to claim 1, wherein said removable clamp segment may be opened.

4. The storage container according to claim 1, wherein said removable clamp segment may be drawn off after detachment.

5. The storage container according to claim 1, wherein each segment of said double clamp is formed having a pair of clamp legs which are adapted to be clipped together.

6. The storage container according to claim 1, wherein the clamp segment facing the bag cavity is shaped as a rounded funnel at this facing side.

7. The storage container according to claim 1, wherein each crimped segment lying between any two storage bags is formed by a double clamping device and an adjoining single clamp.

* * * * *